US011583888B2

(12) United States Patent
Green et al.

(10) Patent No.: US 11,583,888 B2
(45) Date of Patent: Feb. 21, 2023

(54) COATING FRAME AND METHODS OF USING THE SAME

(71) Applicant: Kubota Manufacturing of America Corporation, Gainesville, GA (US)

(72) Inventors: Trevor Green, Cornelia, GA (US); Daniel Jaramillo, Oakwood, GA (US); Jerry Beverly, Laurens, SC (US); Ryan Owen, Jefferson, GA (US); Yuji Yamazaki, Sugar Hill, GA (US)

(73) Assignee: Kubota Manufacturing of Americal Corporation, Gainesville, GA (US)

( * ) Notice: Subject to any disclaimer, the term of this patent is extended or adjusted under 35 U.S.C. 154(b) by 0 days.

(21) Appl. No.: 17/097,136

(22) Filed: Nov. 13, 2020

(65) Prior Publication Data

US 2022/0152647 A1 May 19, 2022

(51) Int. Cl.
*B05C 3/02* (2006.01)
*B05C 13/02* (2006.01)

(52) U.S. Cl.
CPC ..... *B05C 13/02* (2013.01); *B05C 3/02* (2013.01)

(58) Field of Classification Search
None
See application file for complete search history.

(56) References Cited

U.S. PATENT DOCUMENTS 1,750,807 A * 3/1930 Lichtman ..... C25D 17/08 204/297.1
2,258,391 A * 10/1941 Novitsky ..... C25D 17/08 204/297.1
2,512,554 A * 6/1950 Schneider ..... C25D 17/08 204/297.09
5,908,120 A * 6/1999 Yates ..... B05B 5/082 211/119
2012/0273439 A1* 11/2012 Beavers ..... C25D 17/08 211/26

FOREIGN PATENT DOCUMENTS

DE 102014012370 A1 3/2015
JP 2005307228 A 11/2005

* cited by examiner

*Primary Examiner* — Jethro M. Pence
(74) *Attorney, Agent, or Firm* — Hovey Williams LLP; Kameron D. Kelly

(57) ABSTRACT

A coating frame, a coating system, and methods of coating a component using one or more coating frames are disclosed. The coating frame includes a frame member and at least one bracket coupled to the frame member. The bracket includes at least one hanger attachment point extending into a hollow interior of the at least one bracket. The at least one bracket isolates the at least one hanger attachment point from a coating material when the coating frame is used in a coating process. The method includes suspending a component from the coating frame, conveying the coating frame and the component to a coating applicator, and applying a coating material to the coating frame and the component while isolating the at least one hanger attachment point from the coating material via an air pocket formed within the at least one bracket.

20 Claims, 16 Drawing Sheets

COATING FRAME AND METHODS OF USING THE SAME

BACKGROUND OF THE INVENTION

Electrodeposition coating (also referred to electrocoating or e-coating), powder coat painting, and spray painting are three processes conventionally used during the manufacturing of various industrial parts and other manufactured components in order to provide a finished appearance to the part as well as corrosion resistance. At a high level, these coating methods use electrical potential difference to deposit paint, powder, or other coating material on the surface of the part being manufactured. Once cured, the coating provides a corrosion resistant finish that protects the part during use.

For e-coating methods, the parts are typically secured to a conveyor line via a hanger and immersed into the paint to be applied. A positive or negative charge is applied to either the part or paint with the other of the two being grounded. For example, in a typical e-coating process the paint is positively or negatively charged while the part being painted and the frame it is suspended from is grounded such that the charged paint is attracted to, and thus adheres to, the grounded part. For powder coat painting or spray-painting applications, electrically charged powder or liquid paint is sprayed onto a grounded part.

In such systems, the contact point between the hanger and the moving rack or frame, which is either immersed in the paint bath in the case of e-coating or subject to the powder or paint stream in the case of a spray application, becomes coated with powder or paint leading to the resistance of electrical flow or improper grounding to the part being painted. Thus, in order to ensure that subsequent parts get proper paint coverage, the hangers and frame components must be regularly cleaned by burning or otherwise in order to remove the cured paint therefrom and thus maintain proper conductivity during subsequent uses. This requires large oven capacity to accommodate the sizable frame components and thus requires the purchase of numerous industrial ovens or outsourcing to accomplish.

There thus remains a need for a frame system to be used during the painting of manufactured parts and other components, such as during e-coating, powder coat painting, or spray painting, that reduces the contamination of electrical conduct points with paint or powder, and thus reduces the need to clean frame components via large ovens or similar.

BRIEF SUMMARY OF THE INVENTION

Some embodiments of the invention are directed to a coating frame. The coating frame includes a frame member and at least one bracket coupled to the frame member and including a hollow interior. At least one hanger attachment point is coupled to the at least one bracket and extends into the hollow interior of the at least one bracket. The at least one bracket isolates the at least one hanger attachment point from a coating material when the coating frame is used in a coating process.

Other embodiments of the invention are directed to a coating system. The coating system includes a common frame attachable to a conveyor line and a plurality of coating frames operatively and conductively coupled to the common frame. Each of the plurality of coating frames includes a frame member, at least one bracket coupled to the frame member and including a hollow interior, and at least one hanger attachment point coupled to the at least one bracket and extending into the hollow interior of the at least one bracket. The at least one bracket isolates the at least one hanger attachment point from a coating material when the coating frame is used in a coating process.

Still other embodiments of the invention are directed to a method of coating a component. The method includes suspending the component from a coating frame that includes at least one bracket and at least one hanger attachment point coupled to the at least one bracket and extending into a hollow interior of the at least one bracket. The method further includes conveying the coating frame and the component to a coating applicator and applying a coating material to at least a portion of the coating frame and at least a portion of the component via the coating applicator. While applying the coating material, the method includes isolating the at least one hanger attachment point from the coating material via an air pocket formed within the at least one bracket.

These and other features will be discussed in more detail below in connection with the accompanying drawings.

BRIEF DESCRIPTION OF THE DRAWINGS

The present invention is described in detail below with reference to the attached drawing figures, wherein.

DETAILED DESCRIPTION OF THE INVENTION

Generally, aspects of the invention are directed to an improved coating frame used during electrodeposition coating (also referred to electrocoating or e-coating) processes, powder coat painting processes, and/or spray-painting processes that isolates electrical connection points between the various frame components during use such that the connection points do not become coated with the charged paint or powder. This beneficially ensures stable energization from the coating frame to a hanger suspending a part being painted. Moreover, because a coating film is not formed on the connection point on the coating frame, it is not necessary to burn off a coating material from the coating frame after each use.

In some embodiments, the improved coating frame may include one or more brackets that are used to isolate the connection points between the coating frame and the hangers. These one or more brackets trap one or more air pockets within coating frame when the coating frame is dipped into the electrodeposition painting liquid or else subject to a coating spray application process, thereby isolating the hanger connection points from the paint or powder and maintaining proper conductivity between the part being painted and the frame during use. In embodiments employing multiple, horizontally spaced brackets for an e-coating process, buoyancy acts on the air pockets, and thus coating frame, at even intervals, providing enhanced stabilization of the coating frame when it is submerged in the paint bath. As a result, the coating frame is less likely to tilt when immersed in the electrodeposition painting liquid thus preventing air in each bracket from leaking. Moreover, even when the coating frame is somewhat tilted during use due to uneven loading as a result of the irregularly shaped components that are hung from the frame or unevenly dispersed components being hung from the frame, the multiple, horizontally spaced brackets prevent the electrodeposition painting liquid from reaching a respective hanger connection point even as the brackets are submerged into the liquid at different times due to the tilting frame. This ensures that the connection points on the coating frame side do not become coated with the painting liquid, even when the frame is unevenly loaded and thus may otherwise be prone to tipping. These and other aspects of the invention will become more readily apparent with reference to the accompanying figures.

Figure 1:
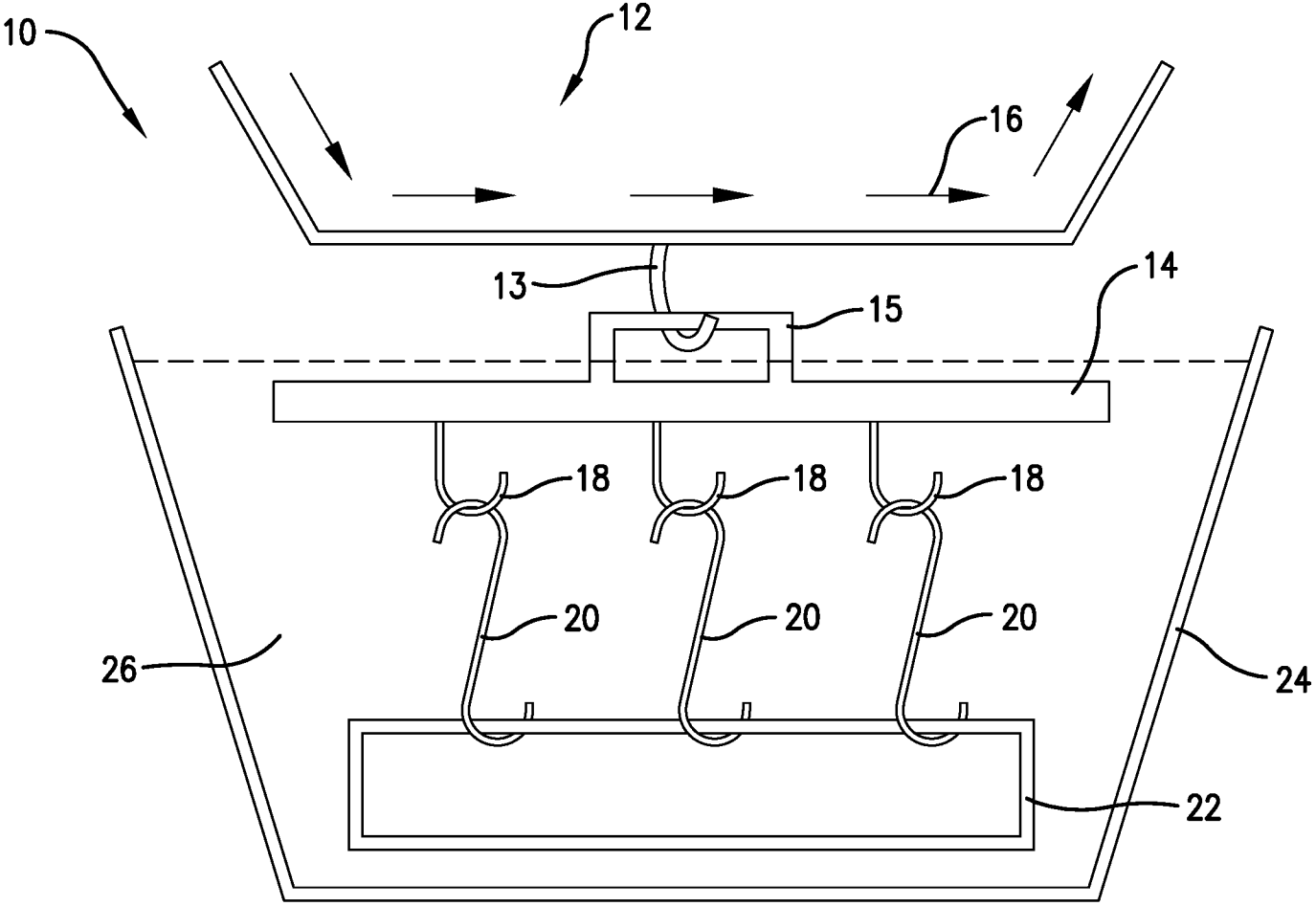
Fig. 1. PRIOR ART
FIG. 1 is a schematic view of a prior art e-coating system.

First, FIG. 1 shows a prior-art e-coating system 10 used to paint industrial components and other parts requiring high corrosion resistance. At a high level, the e-coating system 10 includes a conveyor line 12 and a paint bath 24. The conveyor line 12 may include one or more hooks 13 or other attachment points configured to operatively attach to a coating frame 14 such as by engaging an upstanding member 15 of the frame 14 or another portion of the frame 14. The coating frame 14 includes multiple spaced apart hooks 18 or other attachment points configured to operatively attach to a part 22 being painted. Optionally, the part 22 may be suspended from the hooks 18 or similar via an intermediary hanger 20. In the depicted embodiment, the part 22 is connected to three hooks 18 or attachment points via three hangers 20. The hooks 18, hangers 20, and part 22 are electrically conductive such that an electrical charge or ground applied to conveyor line 12 is in turn applied to the part 22 via the frame 14, hooks 18 and hangers 20. Moreover, the conveyor line 12 and paint bath 24 have an electrical potential difference such that electrodeposition painting liquid 26 within the paint bath 24 is attracted to parts 22 being carried by the conveyor line 12 during use. For example, the conveyor line 12 and components attached thereto (e.g., the frame 14, the hooks 18, the hangers 20, and the part 22) may be grounded, while the electrodeposition painting liquid 26 may be positively or negatively charged.

When using the e-coating system 10 to paint the part 22, the part 22 is hung from the conveyor line 12 by attaching one end of the one or more hangers 20 to a hook 18 or other attachment point and the opposing end of the hanger 20 to the part 22 being painted. At this point (not shown), the part 22 is out of the electrodeposition painting liquid 26. The part 22 will be electrically connected to ground via the conveyor line 12 (or, optionally, electrically charged by applying a positive or negative charge to the conveyor line 12). The conveyor line 12 conveys the frame 14 with the part 22 suspended therefrom along a predetermined path, as schematically depicted by arrows 16, including conveying the part 22 down and into the paint bath 24 and the electrically charged (or optionally grounded) electrodeposition painting liquid 26 provided therein, as shown in FIG. 1. The electrodeposition painting liquid 26 has an electrical potential difference from the part 22 (typically, the paint is positively or negatively charged while the part 22 is grounded) such that the electrodeposition painting liquid 26 is attracted to the surface of the part 22 and adheres thereto, fully coating the part 22. The part 22 is subsequently conveyed out of the paint bath 24 and allowed to dry and cure.

As can be seen in FIG. 1, when the part 22 is conveyed into the paint bath 24, other portions of the electrically charged conveyor line 12 system may also be submerged in the electrodeposition painting liquid 26 in order to ensure full coverage of the part 22 with electrodeposition painting liquid 26. For example, in the embodiment shown, a portion of the frame 14 (including the hooks 18) and the entirety of the hangers 20 are submerged into the electrodeposition painting liquid 26. Because these portions 14, 18, 20 are in electrical communication with the part 22 and thus exhibit the same electrical charge and/or ground, the electrodeposition painting liquid 26 is also attracted to the frame 14, hangers 20, and hooks 18 and thus covers and adheres to the portions of each that are submerged. When the part 22 is conveyed out of the paint bath 24 in order for the electrodeposition painting liquid 26 to dry and/or cure, the electrodeposition painting liquid 26 in turn dries on the hangers 20, hooks 18, and any other portion of the frame 14 that was submerged in the bath 24.

Dipping the hooks 18 and hangers 20 (and possibly other portions of the conveyor line 12 system) into the paint bath 24 causes several known problems. For example, the coating film formed around the contact portion between the hook 18 on the conveyor line side and the hanger 20 becomes a non-conductor, which can result in a poor energization of the part 22 being painted and/or an improper ground. Moreover, the hanger 20 sometimes swings and partly separates from the hook 18, resulting in intermittent contact failure, which may cause a bipolar phenomenon in which the metals of the hook 18 and the hanger 20 at the contact portion melt.

Moreover, the hooks 18 and the hangers 20 become nonconductive when covered with the electrodeposition painting liquid 26. Thus, after each use the hangers 20 and portions of the conveyor line 12 system must be burned or otherwise cleaned after each use to remove the electrodeposition painting liquid 26 therefrom such that they are electrically conductive during subsequent uses. For example, when the hooks 18 form part of the coating frame 14, the entire frame 14 along with the hangers 20 must be removed and placed in a commercial oven to burn the electrodeposition painting liquid 26 prior to subsequent uses so that the coating frame 14, hooks 18, and hangers 20 form an electrically conductive path with the part 22. This is not only time consuming, but because at least the coating frame 14 portions are relatively large, this requires commercial ovens with large capacities or else the burning step must be outsourced, leading to more delays and costs. Furthermore, in order to avoid significant delays in the coating process, many coating frames 14 are necessary in order to have frames 14 readily available for use while others go through the frequent and time-consuming burning process, leading to increased costs and storage requirements.

Figure 2:
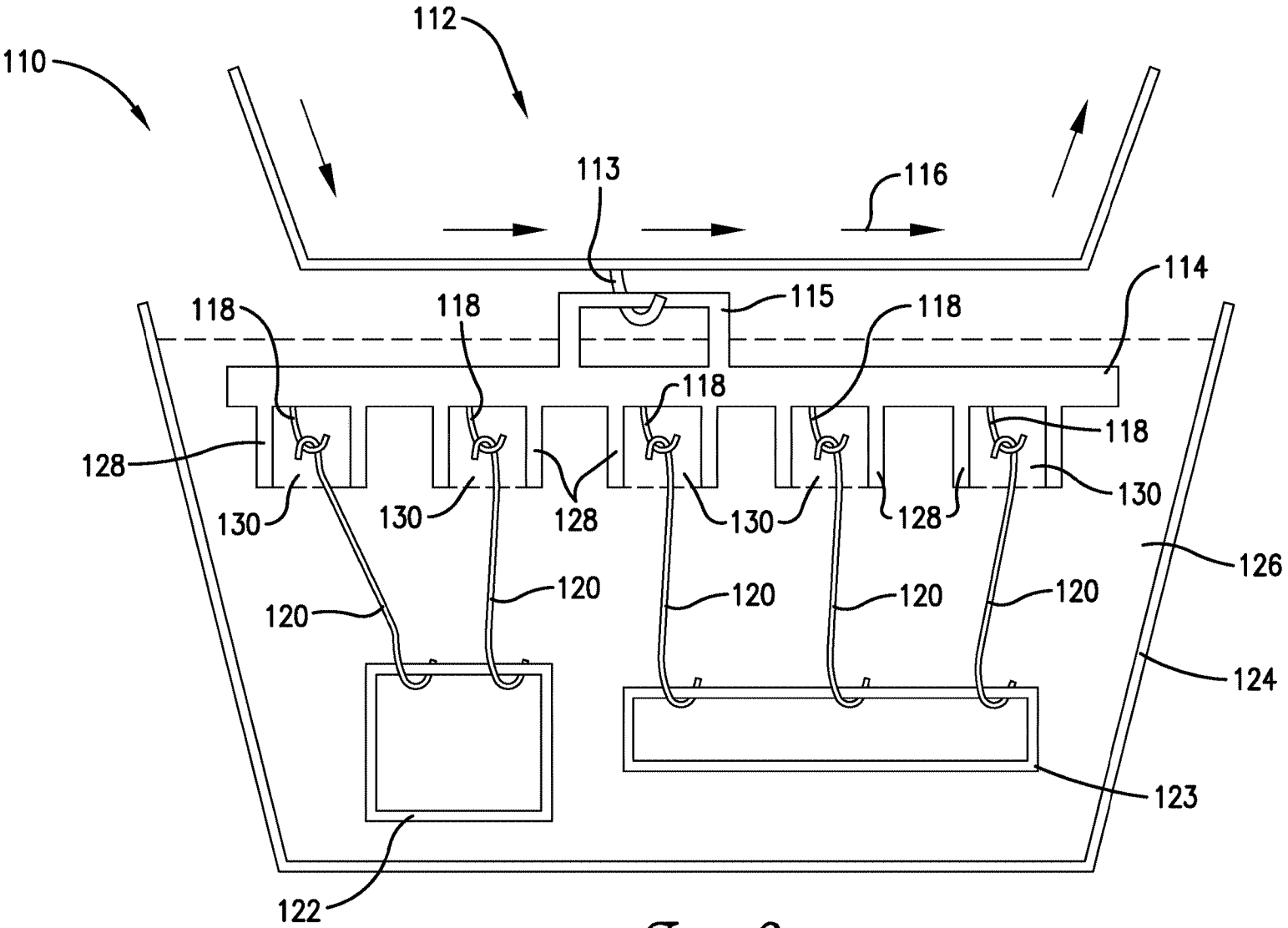
FIG. 2 is a schematic view of an e-coating system according to aspects of the invention.

Turning now to FIG. 2, a schematic of an e-coating system 110 according to one embodiment of the invention is shown. At a high level, the e-coating system 110 includes a conveyor line 112 and a paint bath 124 housing electrodeposition painting liquid 126, which are similar in structure and function as the like-named components described in connection with FIG. 1 and thus will not be discussed again in detail.

In this embodiment, however, the contact point between each hook 118 and hanger 120 is isolated from the electrodeposition painting liquid 126 via an air pocket 130 formed by a respective downward-facing bracket 128. More particularly, in this embodiment the system 110 includes a conductive coating frame 114 with a plurality of downward-facing brackets 128, and each bracket 128 is configured to trap an air pocket 130 within the interior of the bracket 128 when the coating frame 114 is dipped into the electrodeposition painting liquid 126. The air pocket 130 surrounds and isolates the contact point between a respective hook 118 and a hanger 120, thereby preserving the conductive path between the two when the coating frame 114 is lowered into the electrodeposition painting liquid 126. Although in this embodiment there is a one-to-one correspondence between brackets 128 and hooks 118, in other embodiments more or less brackets 128 and/or hanger attachment points (hooks 118) could be employed without departing from the scope of the invention. For example, as will be discussed in connection with FIGS. 12A, 12B, and 13, in some embodiments a single bracket may house multiple hanger attachment points such that one trapped air pocket isolates more than one hanger attachment points from the electrodeposition painting liquid.

Returning the FIG. 2, the coating frame 114 may include an upstanding member 115 that extends above a top surface of the electrodeposition painting liquid 126 and which attaches to the conveyor line 112 via any suitable attachment mechanism such as, in the depicted embodiment, a hook 113. Because the upstanding member 115 is not immersed in the electrodeposition painting liquid 126, no coating is applied between the contact point of the upstanding member 115 and the attachment mechanism 113, thereby preserving the electrically conductive path between the two. Thus, during use there is an unobstructed electrically conductive path between the conveyor line 112, coating frame 114, hook 118, hanger 120, and finally the parts 122, 123. This increases the attraction of the electrodeposition painting liquid 126 to the parts 122, 123 being painted during use and thus results in increased paint adhesion.

Moreover, because the contact point between the hook 118 and the hanger 120 is isolated from the electrodeposition painting liquid 126 via the air pocket 130 and thus is not coated when the coating frame 114, hangers 120, and parts 122, 123 are submerged in the paint bath 124, the coating frame 114 does not need to be burned or otherwise cleaned after each use. Instead, the only portions of the e-coating system 110 that must be regularly burned are the hangers 120, which are relatively small and thus do not require large oven volume or other expensive equipment. That is, although the outer surface of the coating frame 114 will become coated with the electrodeposition painting liquid 126 when submerged in the paint bath 124, because that portion does not comprise a portion of the electrically conductive circuit between the conveyor line 112 and the hangers 120, the coating does not need to be burned or otherwise removed after each use.

The plurality of air pockets 130 formed along the length of the coating frame 114 by the plurality of downward facing brackets 128 further help to balance and stabilize the coating frame 114 as it is submerged into the paint bath 124, which in turn ensures that the downward facing brackets 128 remain substantially vertical during submergence, thereby trapping the air within the airtight interior and isolating the connection point between the hooks 118 and the hangers 120, as discussed. This will be more readily understood with reference to FIG. 3, which shows the e-coating system from FIG. 2 but with the hooks 118, hangers 120, and parts 122, 123 that are being painted omitted for clarity.

As the coating frame 114 is submerged within the paint bath 124, air becomes trapped within each airtight interior of the downward-facing brackets 128, forming the air pocket 130 discussed above in connection with FIG. 2. Thus, each of the brackets 128 displaces a volume of electrodeposition painting liquid 126 substantially equal to the combined volume of the shell of the downward facing bracket 128 and airtight interior thereof, schematically illustrated by arrows 134. More particularly, although some electrodeposition painting liquid 126 may enter the interior of each of brackets 128 due to the compressible nature of the air provided therein and/or due to any tilting of the coating frame 114 and the open lower end thereof, the electrodeposition painting liquid 126 only enters a few centimeters into the hollow interior of the brackets 128 and notably cannot reach the connection point between the hook 118 and the hanger 120.

As should be appreciated, this displaced electrodeposition painting liquid 126 results in a greater buoyancy force acting on the coating frame 114 at evenly spaced intervals, schematically represented by arrows 132. When the coating frame 114 is dipped into the electrodeposition painting liquid 126, the buoyancy force acting on the air pockets 130 at evenly spaced intervals (arrows 132) results in a relatively stable coating frame 114 that is difficult to tilt. As a result, the air in each of the air pockets 130 formed with the downward facing brackets 128 cannot escape, providing ample isolation and protection for each of the hooks 118 during painting.

Although the benefits of the coating frame 114 has been shown and discussed in connection with the e-coating system 110, similar benefits are realized when the coating frame 114 is used during a spray application process such as a powder coat or spray paint application process or the like. Again, during a spray application process, rather than submerging the fame 114 and any parts 122, 123 attached thereto into a paint bath 124, electrically charged powder or paint is sprayed directly at the hanging parts 122, 123 and thus coating frame 114 as the coating frame 114 moves along the conveyor line 112 (schematically depicted by arrows 116). When the coating frame 114 with spaced apart downward facing brackets 128 is used during such a process, the connection point between the hook 118 and the hanger 120 is protected because the opening formed by the brackets 128 is facing downwards and thus away from the typical orientation of a spray nozzle.

Moreover, even if a spray nozzle is oriented below the open lower end of each of the brackets 128 and in such a way that the paint is dispersed upwards towards the open downwardly facing end of the brackets 128, the connection point between the hook 118 and hanger 120 is nonetheless protected by a faraday cage effect generated by the air pocket 130 and/or the bracket 128. Thus, even if the stream of electrically charged powder or spray paint is directed towards an interior of the brackets 128, the powder or paint will not reach the connection point between the hook 118 and the hanger 120 but instead be attracted to the distal (i.e., open) ends of the walls of the brackets 128, and thus deposited thereon, which will be discussed more fully below with respect to FIG. 14. Thus, much like the operation of the coating frame 114 when used in an e-coating process 110, the coating frame 114 protects the connection point between the hook 118 and the hanger 120 when used in other processes such as a powder coating or spray-painting process, reducing or eliminating the need to clean or burn coating frame 114 components after application of paint to the various parts 122, 123 being painted. For such powder coating, spray painting, or other spray application processes, the brackets 128 optionally may not be airtight, as is the case when using the coating frame 114 in an e-coating or other paint bath application. This is because the faraday cage effect may be realized by the mere configuration of the bracket 128, whether or not the hollow interior is airtight.

Figure 3:
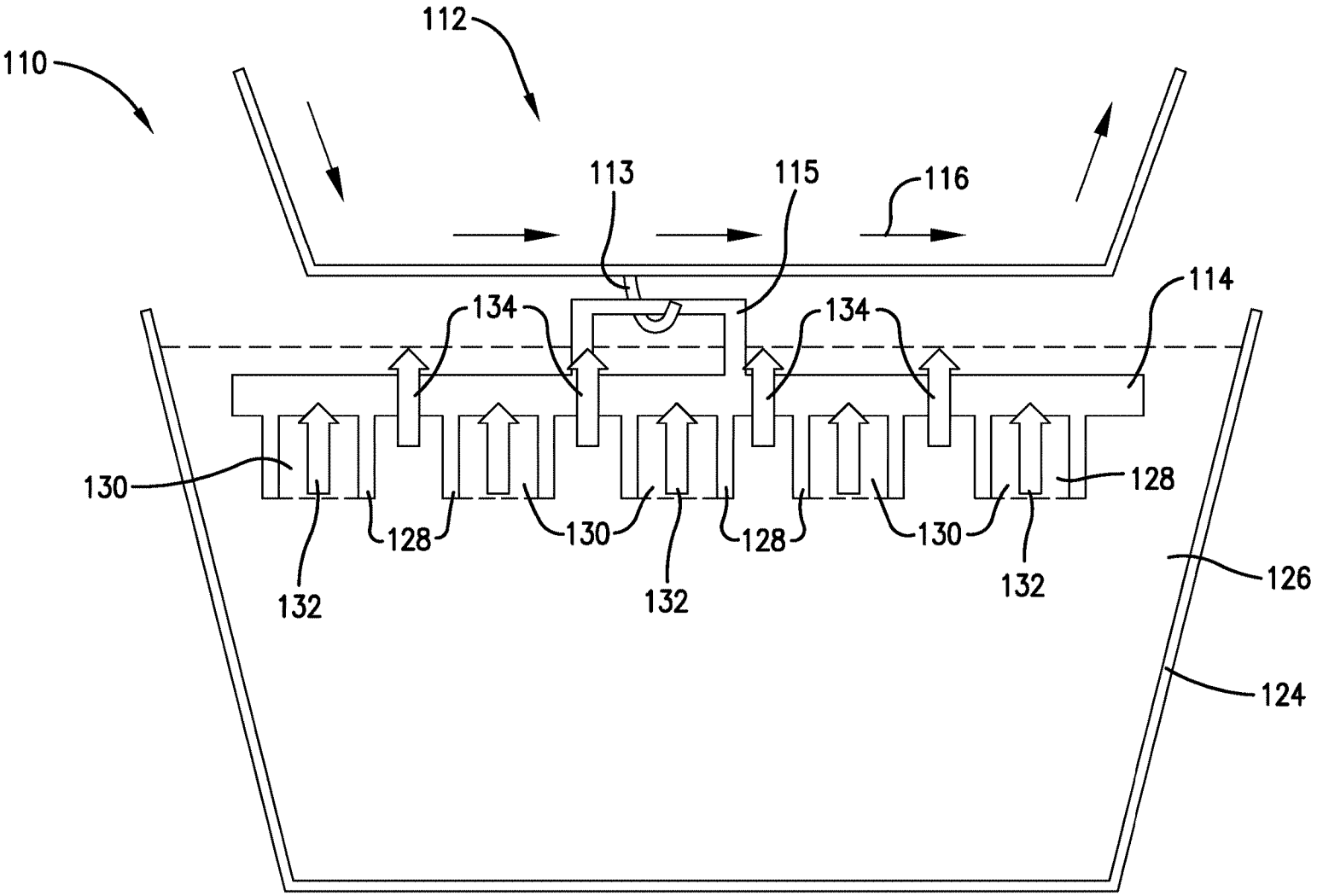
FIG. 3 is a schematic view of the e-coating system shown in FIG. 2 and schematically showing representative forces acting on a coating frame of the system during use.
Figure 4:
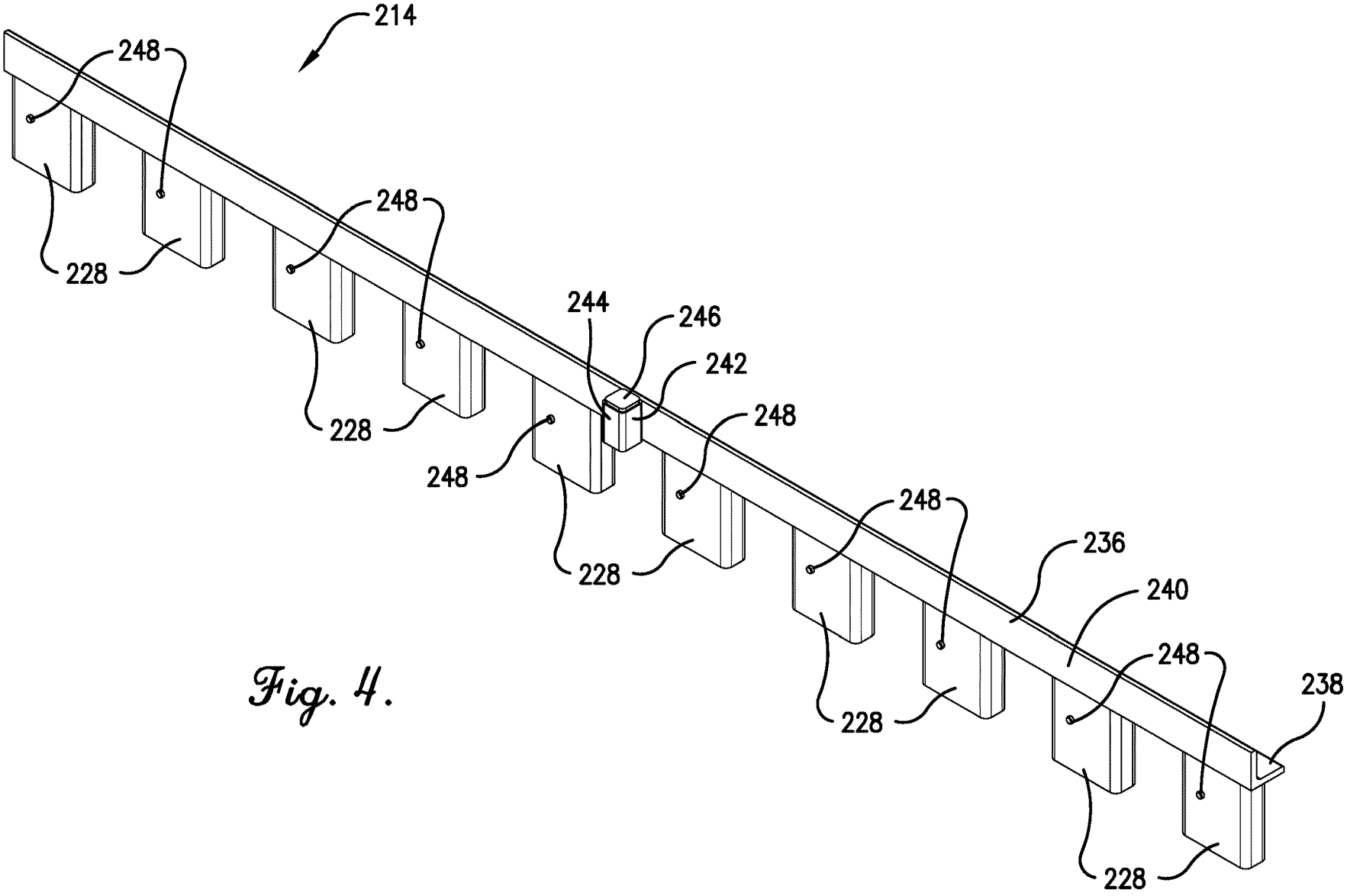
FIG. 4 is a perspective view of a coating frame according to one embodiment of the invention to be used in a coating system.
Figure 5:
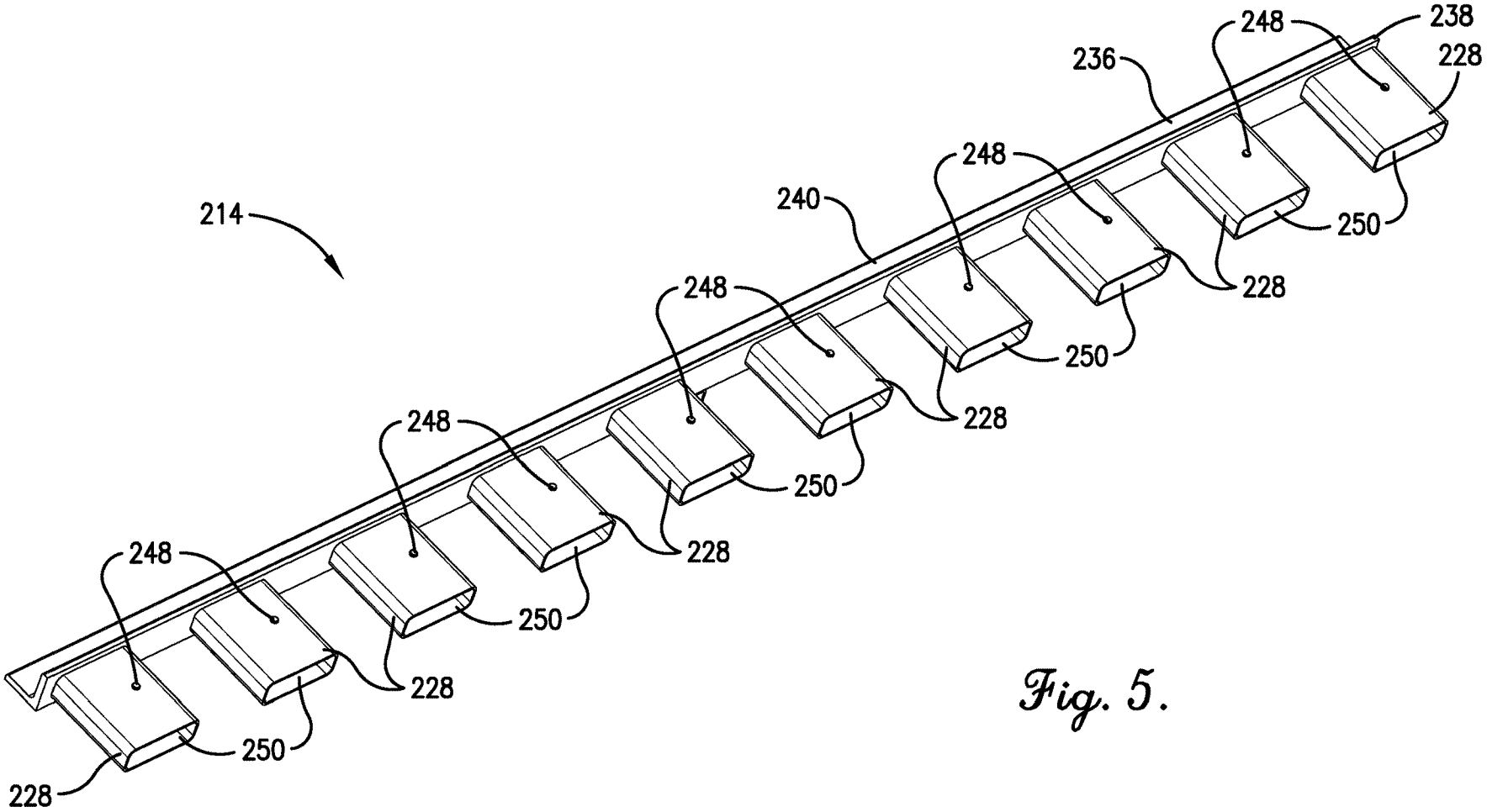
FIG. 5 is another perspective view of the coating frame shown in FIG. 4.

Although aspects of the invention were discussed at a high level in connection with FIGS. 2 and 3, FIGS. 4-9 show in detail one embodiment of a coating frame 214 that can be used in an e-coating system such as that shown in FIGS. 2-3, or in a spray application process such as a powder coat process or spray painting process, which will be discussed in connection with FIG. 14, and that exhibits the benefits discussed herein including isolating a connection point between the coating frame 214 and a hanger 220 used to suspend an part being coated from the coating frame 214 thereby improving electrical conductivity during a coating process while reducing the number of components that need to be cleaned or burned after each use.

The coating frame 214 includes a plurality of downward facing brackets 228 fixedly attached to a frame member 236. The brackets 228 can be any suitable size and shape in which presents a hollow interior for housing a hanger connection point therein. In the depicted embodiment, each bracket 228 is a rectangular tubular member, and in one preferred embodiment each is formed from 3 inch×1 inch×⅛ inch rectangular tubing, although other size and shape tubing may be employed without departing from the scope of the invention. For example, tubing with round, oval, square, or other cross-sections may be employed without departing from the scope of the invention. The brackets extend in a vertical direction any suitable length to sufficiently protect a hanger attachment point during use (as will be discussed more fully), and in some embodiments may be between 1 and 10 inches in length, and more preferably between 2 and 6 inches in length, and even more preferably approximately 3.5 inches in length.

Figure 6:
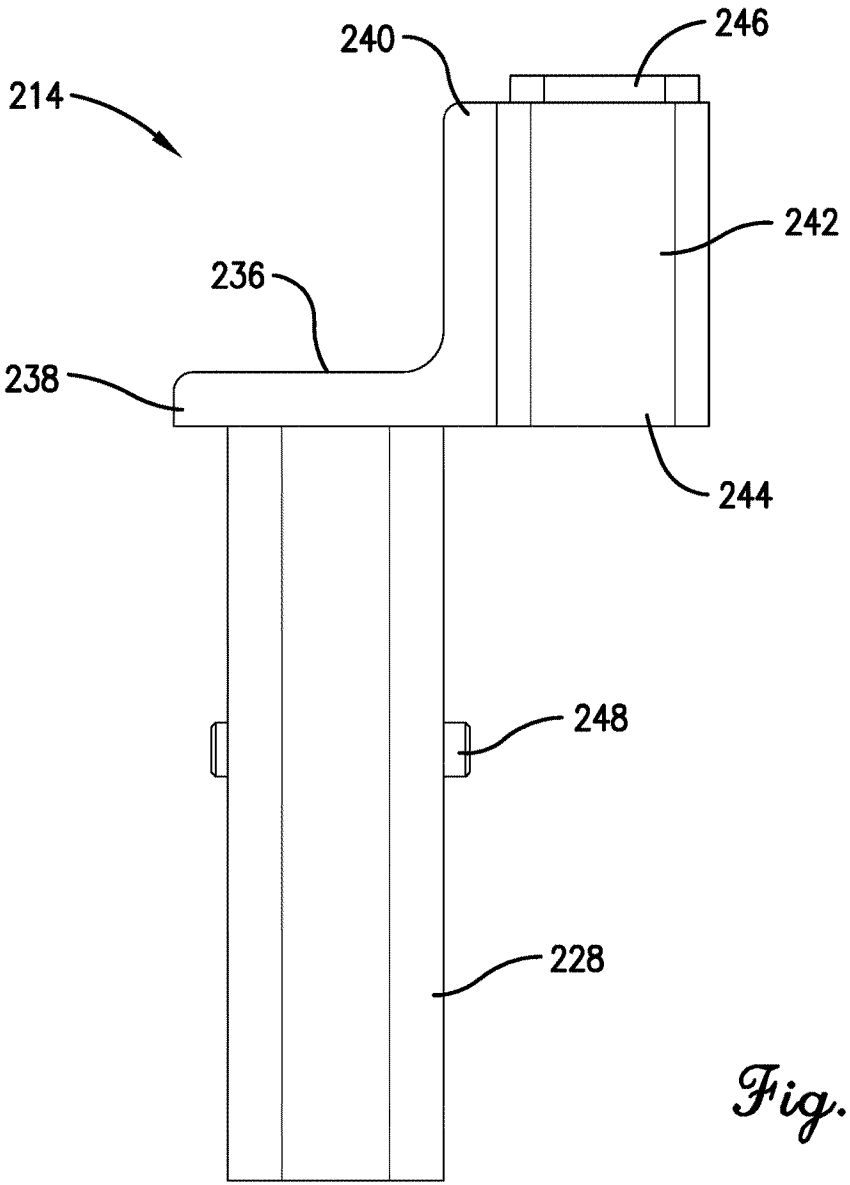
FIG. 6 is a right-side elevation view of the coating frame shown in FIGS. 4-5.
Figure 8:
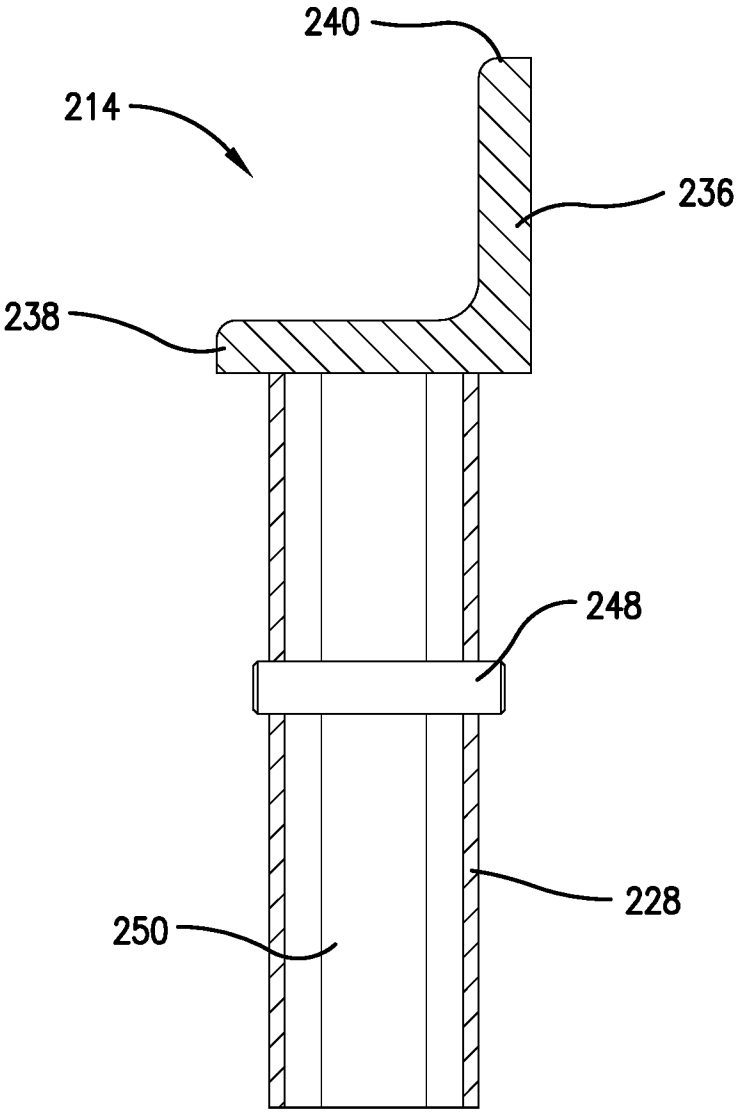
FIG. 8 is a cross-sectional view of the coating frame shown in FIGS. 4-7 and viewed along line 8-8 in FIG. 7.

In the depicted embodiment, the brackets 228 are aligned and spaced apart from one another in the horizontal direction, but in other embodiments the brackets 228 may be differently oriented including in a vertical direction or otherwise. The brackets 228 can be fixedly attached to the frame member 236 in any conventional manner and in some embodiments an upper end of each of the brackets 228 is welded in an airtight manner to the frame member 236. In the depicted embodiment, the frame member 236 is substantially L-shaped in cross-section with a first portion 238 extending approximately at a right angle to a second portion 240, as best seen in FIGS. 6 and 8. In such embodiments, the brackets 228 are welded to the first portion 238 of the frame member 236 thereby sealing, in an airtight manner, the open upper end of the brackets 228. Again, for powder coating, spray painting, or other spray application processes, the brackets 228 optionally may not be airtight, because the faraday cage effect, which prevents a coating material from coating the hanger connection point, may be realized by the mere configuration of the bracket 228, whether or not the hollow interior is airtight.

The frame member 236 can take other suitable cross-sectional shapes and configurations without departing from the scope of the invention. For example, the frame member 236 could be square, rectangular, or round tubing or similar. In embodiments in which the frame member 236 is L-shaped in cross-section (as shown), the frame member 236 may be constructed from angle steel or the like, such as, in one non-limiting example, 1.5 inch×1.5 inch×¼ inch angle steel. The frame member 236 may extend any desired length in the horizontal direction in order to accommodate the plurality of brackets 228. In some embodiments, the frame member 236 may extend between 20 and 100 inches in the horizontal direction, and more preferably between 30 and 80 inches in the horizontal direction, and more preferably approximately 56.5 inches in the horizontal direction. The brackets 228 may be spaced evenly or non-evenly along the frame member 236 without departing from the scope of the invention. As should be appreciated, and by way of example, in the depicted embodiment there are 10 brackets spaced evenly along the frame member 236. Thus, when the brackets are formed from 3 inch×1 inch×⅛ inch rectangular tubing and the frame member is approximately 56.5 inches long, each bracket 228 is spaced approximately 3 inches apart from each neighboring bracket 228.

Each of the plurality of brackets 228 includes a rod 248 or other suitable hanger attachment point (e.g., hook or similar) that interacts with a corresponding hanger 220 during use of the coating frame 214 (FIGS. 9, 11, and 14) and which provides an electrical connection between the coating frame 214 and the hanger 220 (and thus the part being painted) during use, as will be discussed more fully below. As best seen in the sectional view shown in FIG. 8, which is a view cut through one of the brackets 228 and more particularly along a vertical plane that runs through the center of the rod 248, in some embodiments the rod 248 extends through two correspondingly sized through-holes provided in the bracket 228 and then fixedly secured to the bracket 228.

The rod 248 or other hanger connection point may be any suitable size and shape to provide electrical connection with a hanger during a coating process. For example, in some embodiments the rod 248 may be a threaded or unthreaded rod, and in some embodiments may be a ¼-20 threaded rod. The rod 248 may be any suitable length to fully extend through the opposing side walls of the brackets 228, as best seen in FIG. 8. For example, in embodiments in which the brackets are constructed from 3 inch×1 inch×⅛ inch rectangular tubing, the rod 248 may be more than 1 inch in length such that the opposing ends thereof extend beyond the respective side walls of the bracket 228. For example, in one non-limiting example the rod 248 may be approximately 1.5 inches in length.

Figure 9:
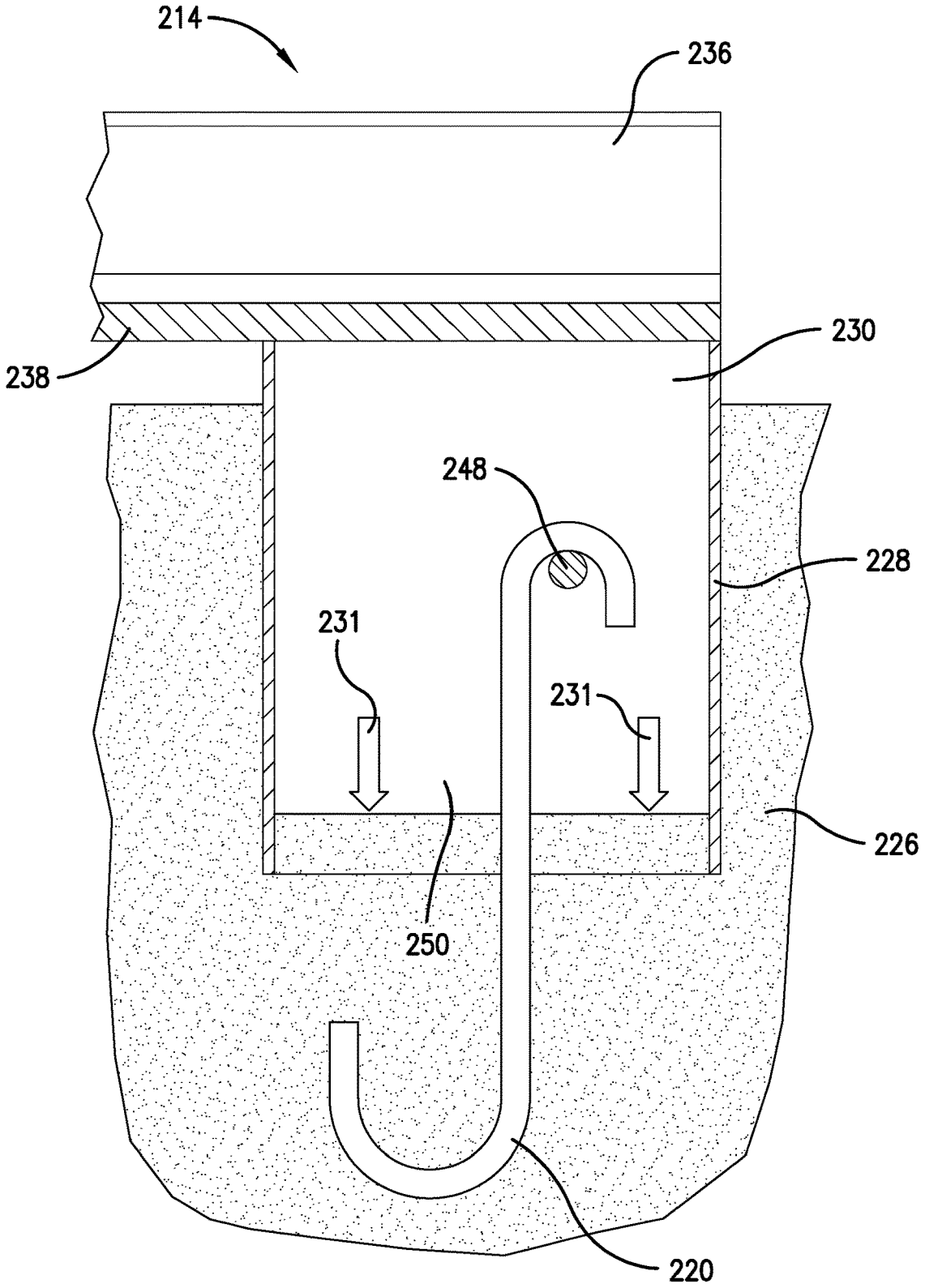
FIG. 9 includes a close-up, sectional view of one of the brackets of the coating frame shown in FIGS. 4-8 shown in a paint bath.

In one non-limiting example, the rod 248 is welded to the bracket 228 at each of the through holes in an airtight manner such that, during use, no trapped air can escape around the rod 248 and no electrodeposition painting liquid 226 can penetrate into the interior of the bracket 228 via the through holes. This may be more readily understood with reference to FIG. 9, which shows a single bracket 228 with the corresponding portion of the horizontal frame member 236 attached to an upper end thereof, fixedly sealing the open upper end in an airtight manner. Also shown in FIG. 9 is a double-sided hanger 220 as one example of a hanger that can be used to suspend a part being painted from the coating frame 214 during use. As shown in FIG. 9, the walls of the bracket 228 define a hollow interior 250. Again, rod 248 and horizontal frame member 236 are fixedly attached (e.g., welded) to the walls of the bracket 228 in an airtight manner such that no air within the hollow interior 250 can escape around the rod or via the upper end of the bracket 228 during use.

As the bracket 228 is lowered into the electrodeposition painting liquid 226, air within the hollow interior 250 of the bracket becomes trapped, compresses slightly, and forms a trapped air pocket 230 resisting electrodeposition painting liquid 226 from entering the hollow interior 250. More particularly, the air pocket 230 exerts a force on the electrodeposition painting liquid 226 as the air pocket compresses, schematically represented by arrows 231, which prevents the electrodeposition painting liquid 226 from entering the interior 250 of the bracket 228. In this regard, the electrodeposition painting liquid 226 coats the lower portion of the hanger 220, but notably not the top portion—i.e., the portion of the hanger 220 that forms the electrical connection with the rod 248 and thus the coating frame 214—nor the portion of the rod 248 itself that is within the hollow interior of the bracket 228. This ensures a good electrical connection during application of the electrodeposition painting liquid 226 and further reduces the parts the that must be burned or cleaned after use, as discussed.

Figure 14:
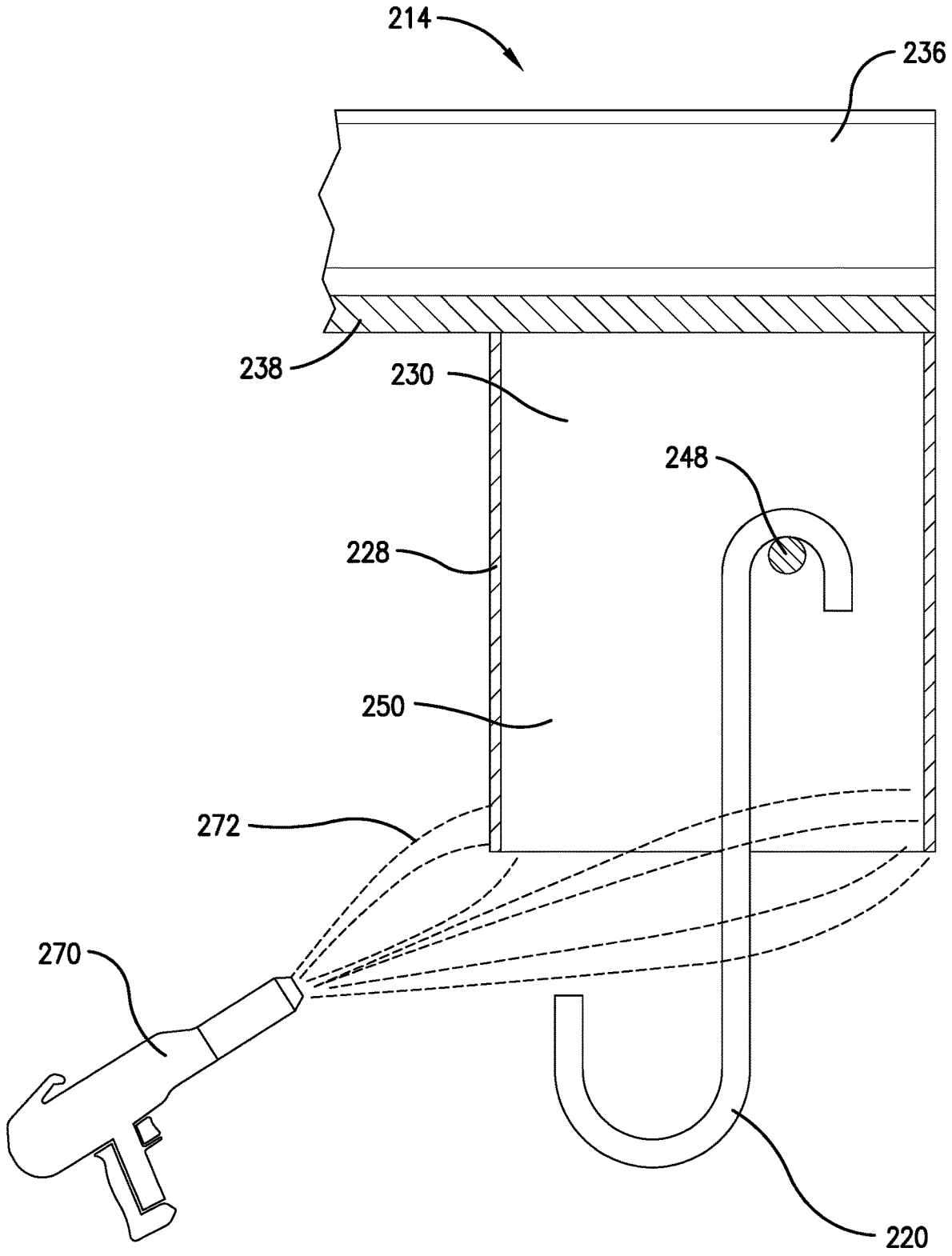
FIG. 14 includes a close-up, sectional view of one of the brackets of the coating frame shown in FIGS. 4-8 and being subject to a spray applicator.

As schematically shown in FIG. 14, which presents a similar view of a bracket 228 as that shown in FIG. 9 but which is being subjected to a spray application process such as a powder coating process or spray-painting process, similar benefits would be realized when using the coating frame 214 during a spray application process. More particularly, as a sprayed-on coating 272 (e.g., powder or spray paint) is applied to the part and thus surrounding coating frame 214 members including portions of the bracket 228 via a spray applicator 270, the small opening of the brackets 228 creates a faraday cage effect that repels the charged paint or powder particles away from the contact point between the rod 248 and the hanger 220. That is, the charged paint or powder 272 is instead attracted and adheres to the distal, open end of the bracket 228 without traveling far enough into the open interior 250 of the bracket 228 to contaminate the contact point between the hanger 220 and the hanger attachment point (e.g., rod 248 or similar).

In either event, by utilizing the coating frame 214 during an e-coating or spray application process, only the small hangers 220 need to be regularly burned. This drastically improves available space in the ovens, thereby reducing the need to acquire additional equipment while producing the same amount of product and thus reducing cost as well as negative environmental impacts of the cleaning processes.

In some embodiments, multiple ones of the coating frame 214 may be operatively and electrically connected (or grounded) to a vertically extending common frame such as a spine hanger 252 or other supportive frame, which in turn is operatively connected to the conveyor line 212. In such embodiments, multiple coating frames 214 can be immersed into the electrodeposition painting liquid 226 at once. Accordingly, in some embodiments the coating frame 214 may include a spine mount 242 configured to attach to a corresponding post 256 of the spine hanger 252. As best seen in FIGS. 4, 6, 7 and 10, the spine mount 252 is provided approximately at the center of the horizontal frame member 236 and is a tubular member that with an open lower end, much like the brackets 228.

Figure 7:
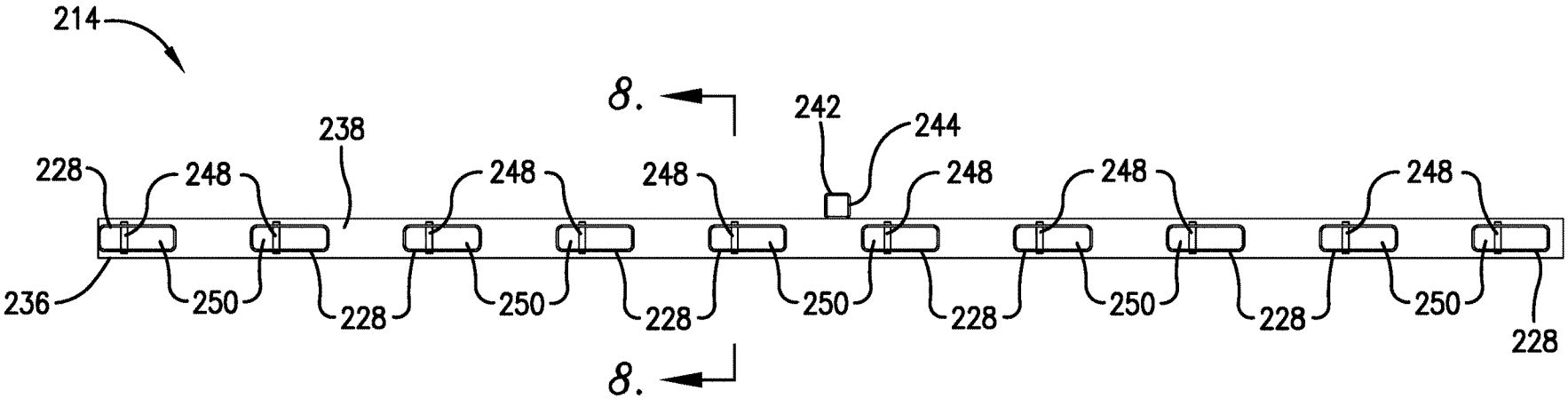
FIG. 7 is a bottom view of the coating frame shown in FIGS. 4-6.

More particularly, the spine mount 252 includes a tube portion 244—which in the depicted embodiment is substantially square in cross-section, FIG. 7, but which could be other tubular designs such as one having a round, oblong, or other cross-section—that forms a hollow interior. The tube portion 244 is fixedly mounted (e.g., welded) to the horizontal frame member 236, and more particularly the second, vertically upstanding portion 240 of the horizontal frame member 236, at a center thereof. A like-sized and shaped cap 246 is fixedly mounted (e.g., welded) to the upper end of the tube portion 244 in an airtight manner. Thus, much like the brackets 228, the spine mount 242 is airtight except for the open, downward facing end thereof. In one non-limiting example, the spine mount can be constructed from square tubing such as 1-¼ inch×1-¼ inch×⅛ inch square tubing or similar. The tubing may extend any desirable length in the vertical direction in order to provide the electrical isolation benefits described herein, and in some embodiments may extend between 1 and 6 inches, and more preferably between 1.5 and 4 inches in length, and more preferably approximately 2 inches in length.

Figure 10:
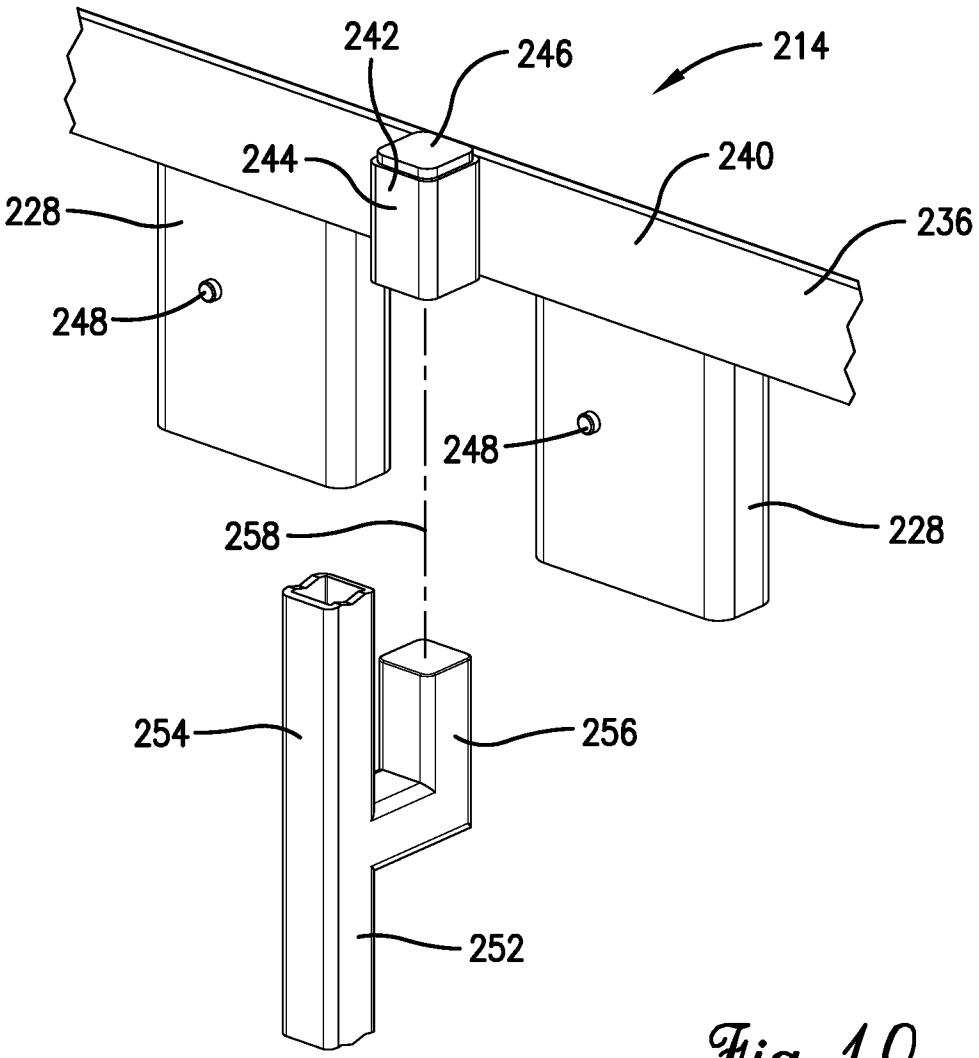
FIG. 10 is a partial perspective view of the coating frame shown in FIGS. 4-9 and a corresponding partial perspective view of a spine hanger according to aspects of the invention.
Figure 11:
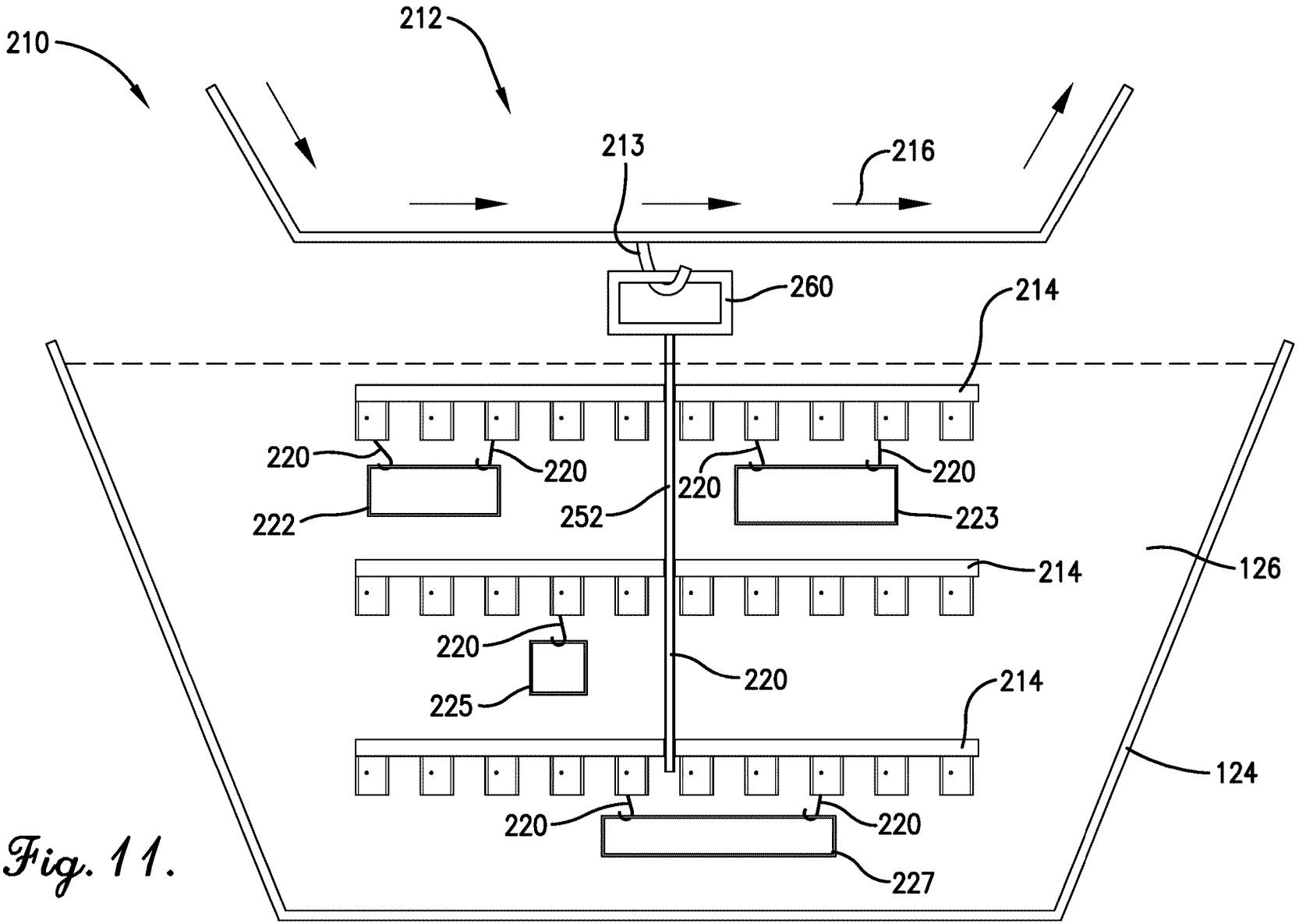
FIG. 11 is a schematic view of an e-coating system according to aspects of the invention that employs a spine hanger and multiple ones of the coating frames shown in FIGS. 4-10.

As shown in FIGS. 10 and 11, when multiple coating frames 214 are to be immersed in the electrodeposition painting liquid 226 at once, a spine hanger 252 can be employed to vertically mount and space the coating frames 214 with respect to one another. As best seen in FIG. 10, in some embodiments the spine hanger 252 may include a vertically extending main frame 254 with multiple hook-shaped posts 256 extending outwardly therefrom. To mount each coating frame 214 onto a corresponding one of the posts 256, the spine mount 242 is placed around the post 256, as schematically depicted by broken line 258 in FIG. 10. In this regard, much like the brackets 228 protecting the connection point between the hanger 220 and the rod 248, the spine mount 242 traps an air pocket within the hollow interior thereof that protects the connection point between the post 256 and the coating frame 214. This ensures a consistent electrical connection between the spine hanger 252 and the coating frame 214 during use as well as reduces the number of components that need to be regularly cleaned or burned.

This will be more readily understood with reference to FIG. 11, which shows an e-coating system 210 that includes multiple coating frames 214 operatively coupled to a spine hanger 252. The e-coating system 210 includes a conveyor line 212 configured to move various parts 222, 223, 225, 227 through a paint bath 224 as schematically illustrated by arrows 216, or else through a spray applicator station (not shown). In that regard, the conveyor line 212 may include a hook 213 or other attachment point configured to operatively attach to and support a coating frame 214 and/or a spine hanger 252, as is the case in the depicted embodiment. In that regard, the spine hanger 252 may include a bracket 260 or other attachment portion at an upper end thereof for operatively coupling to the conveyor line 212 and/or hook 213 thereof.

The spine hanger 252 is in turn operatively coupled to multiple coating frames 214 such as, in the depicted embodiment, three vertically stacked coating frames 214. Again, in some embodiments this may be accomplished by sliding a spine mount 242 of each coating frame 214 over a corresponding post 256 of the spine hanger 252. A plurality of parts 222, 223, 225, 227 to be coated are then suspended from one or more of the coating frames 214 via hangers 220.

More particularly, each hanger 220 extends from a rod 248 within one of the brackets 228 to one of the parts 222, 223, 225, 227. Each of the parts 222, 223, 225, 227 are in turn electrically charged or grounded via the conveyor line 212, spine hanger 252, and coating frames 214, as discussed. In this regard, when the parts 222, 223, 225, 227 are submerged into the oppositely charged electrodeposition painting liquid 226 (or subjected to electrically charged powder or spray paint in a spray application), the liquid 226, powder, or spray paint is attracted to and thus adheres to the parts 222, 223, 225, 227.

As seen in FIG. 11, when multiple coating frames 214 are stacked via a spine hanger 252 in this manner, at least some of the coating frames 214 will be fully submerged in the electrodeposition painting liquid 226 when the spine hanger 252 is conveyed through the paint bath 224. Nonetheless, the connection points between the hangers 220 and the rods 248, and between the posts 256 of the spine hanger 252 and the spine mounts 242, will remain isolated from the electrodeposition painting liquid 226 via the air pockets formed within the brackets 228 and spine mounts 242, respectively. As discussed, this ensures a consistent electrical contact during the painting process as well as reduces the number of parts of the e-coating system 210 that must be regularly cleaned or burned after each use. And as should be appreciated from the discussion herein, although not shown when the multiple coating frames 214 are mounted to a spine hanger 252 in the manner shown in FIG. 11 and used in a powder paint coating process or other spray coating process, the electrical connections between the hangers 220 and the rods 248, and between the posts 256 of the spine hanger 252 and the spine mounts 242, will remain isolated from the electrically charged powder paint via the faraday cage effect formed by the brackets 228 and spine mounts 242, respectively.

Figure 15:
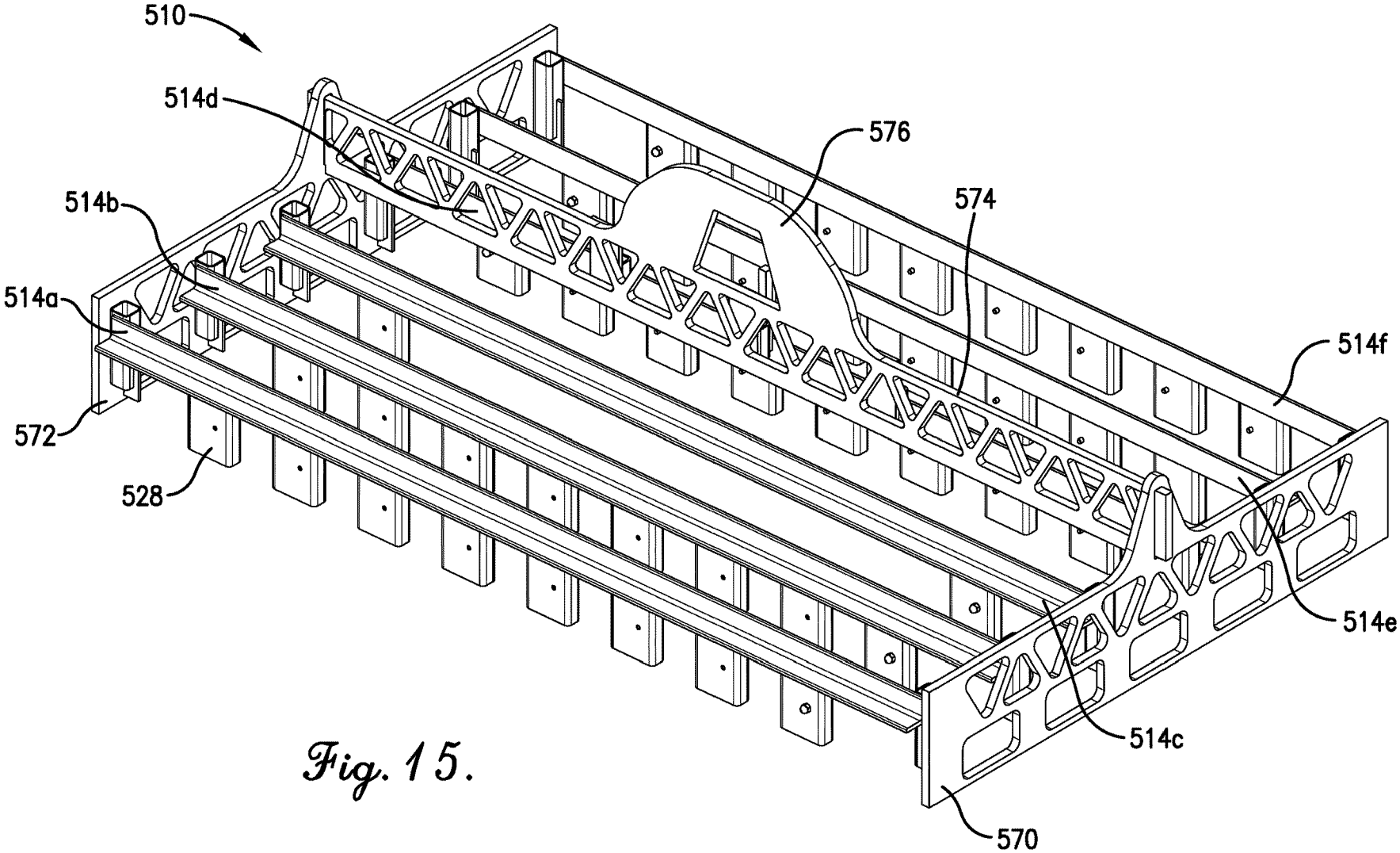
FIG. 15 is a perspective view of a coating frame according to yet another embodiment of the invention to be used in a coating system.

Moreover, as shown in FIG. 15, in some embodiments multiple coating frames 514*a-f* could be mounted and arranged in a horizontal direction to form a larger common frame 510. In this embodiment, the coating frames 514*a-f* may each include one or more brackets 528 that are similar in structure and configuration as the other downward facing brackets discussed here. For example, coating frames 514*a*, 514*b*, 514*d*, 514*e*, and 514*f* each include eight brackets 528, while coating frame 514*c* includes two brackets 528. In other embodiments, more or less coating frames 514 may be included in the common frame 510 and/or each frame 514 may include more or less brackets 528 without departing from the scope of the invention.

The distal ends of the coating frames 514*a-f* are fixedly (e.g., welded or otherwise) or non-fixedly coupled to a pair of opposing common end frame members 570, 572 such that the coating frames 514*a-f* are mounted and arranged in a linear, horizontal array, with each frame 514*a-f* being horizontally spaced from at least one neighboring frame 514*a-f*. The end frame members 570, 572 may in turn be fixedly (e.g., welded or otherwise) or non-fixedly coupled to a hanging frame member 574 including an upstanding portion thereof 576 configured to be coupled to a conveyor line in a similar manner as the other frames and corresponding upstanding members discussed herein. The common frame 510 configuration shown in FIG. 15 may be beneficial to accommodate a relatively large part being coated. When arranged in such a configuration, the respective hanger connection points in each of the multiple frames 514*a-f* remain protected from the coating material during a coating process due to the airtight hollow interior within each bracket 528 and/or due to the faraday cage effect realized by the configuration of each bracket 528, as discussed.

Although embodiments of the invention have been discussed in connection with a plurality of brackets 228 spaced apart in the horizontal direction, with each including a respective rod 228 as an example of a hanger attachment point, the invention is not so limited and in other embodiments the coating frame may include more than one hanger attachment points or rods within each bracket. And in some embodiments the coating frame may only include a single bracket with each of the plurality of hanger attachment points or rods provided within the common bracket. This may be more readily understood with reference to the embodiments shown in FIGS. 12A, 12B, and 13.

Figure 12A:
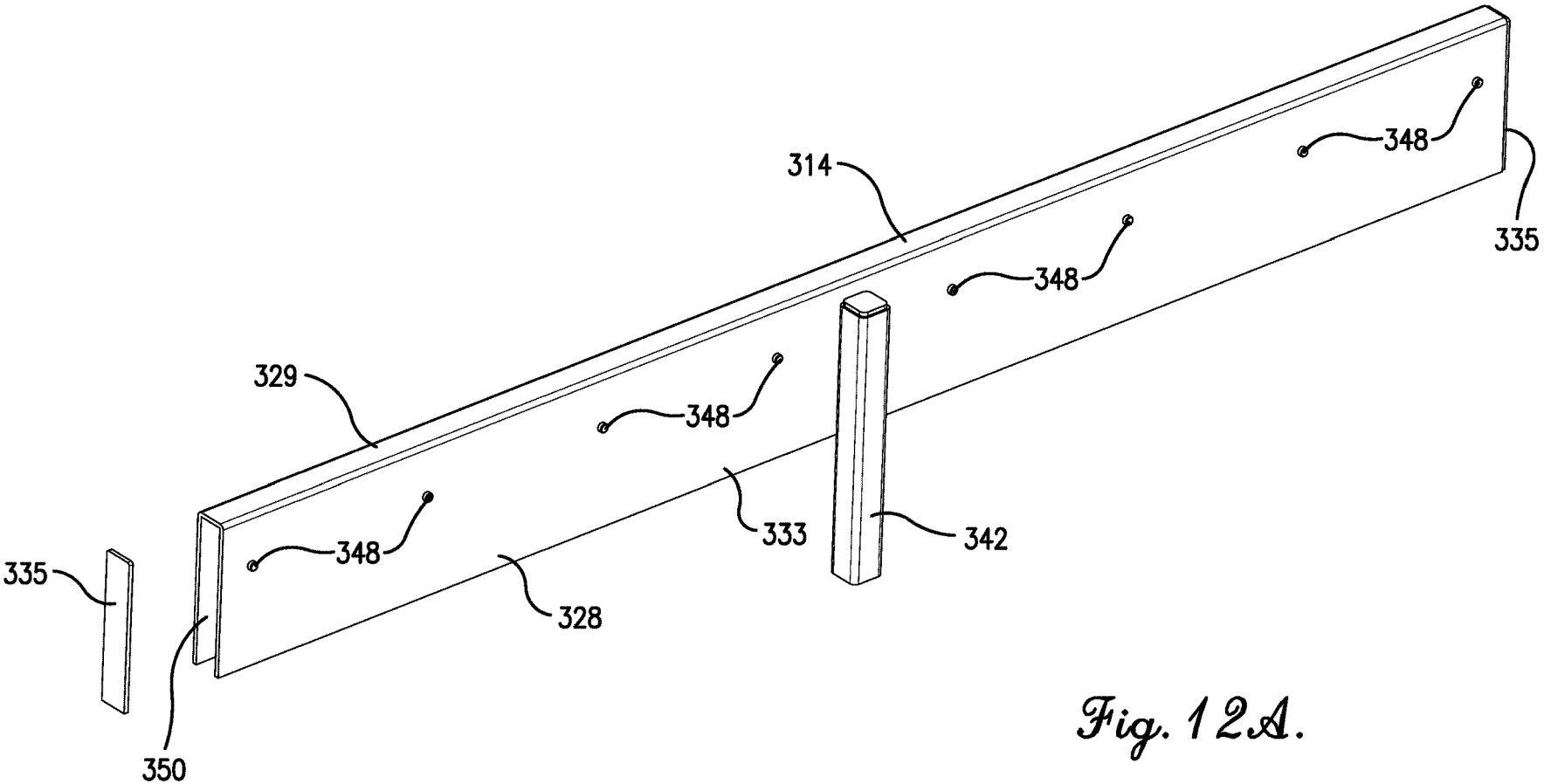
FIGS. 12A and 12B are perspective views of coating frames according to other embodiments of the invention to be used in a coating system.
Figure 13:
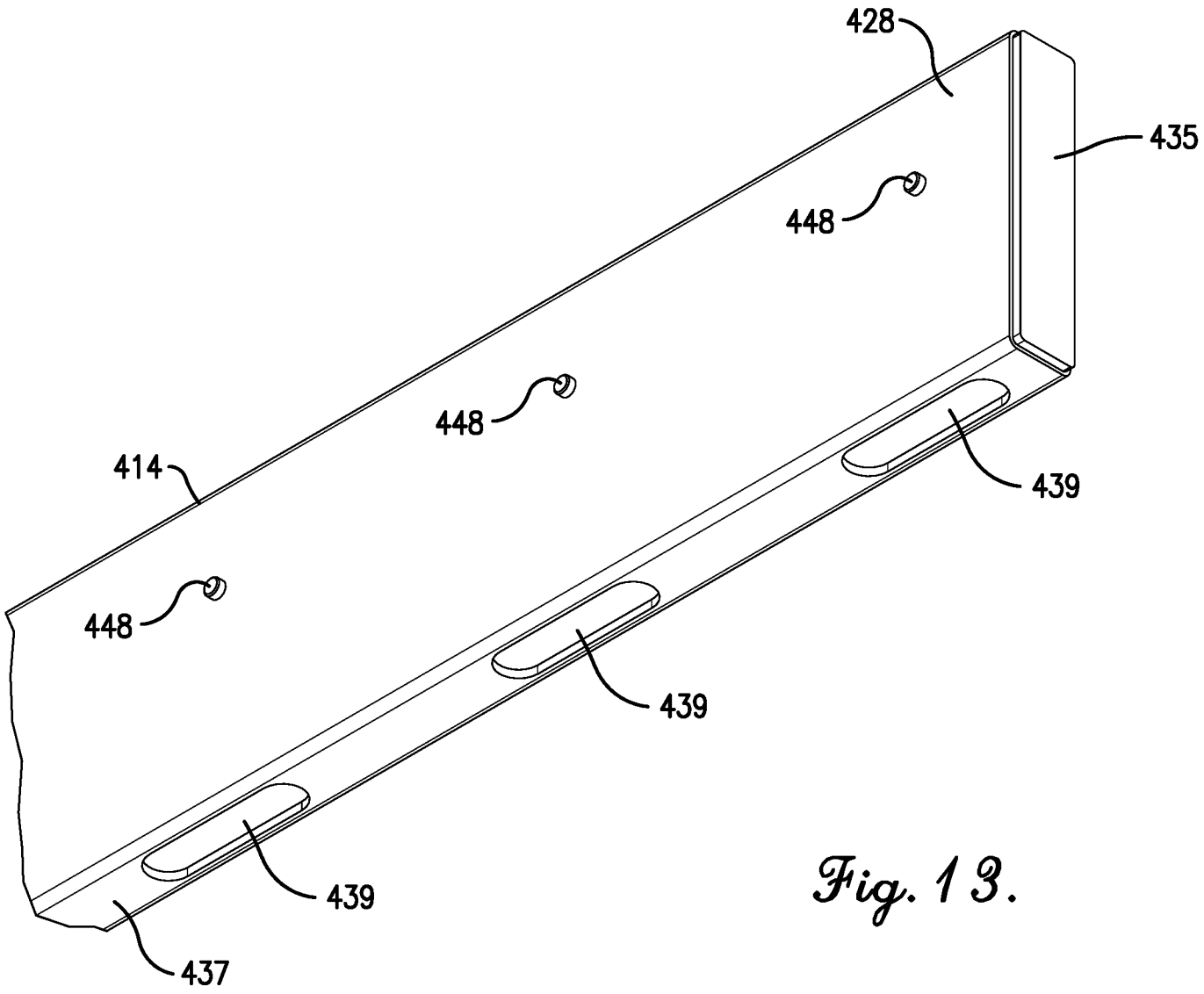
FIG. 13 is a perspective view of a coating frame according to yet another embodiment of the invention to be used in a coating system.

First, FIG. 12A shows a coating frame 314 according to one embodiment of the invention. In contrast to the multiple downward facing brackets 228 included on the coating frame 214 discussed above, in this embodiment the coating frame 314 includes a single bracket 328 having an open, downward facing end with multiple hanger attachment points (i.e., rods 348 in the depicted embodiment) provided within an interior of the common bracket 328. The bracket 328 may be formed from multiple discrete components that are welded or otherwise fixedly attached in an airtight manner to form the hollow interior 350.

For example, in the depicted embodiment the bracket 328 is formed by overlapping and welding two horizontally extending channel pieces 329, 333, and capping each horizontal end of the welded assembly with a cap 335. The rods 348, in turn, are each inserted through respective through holes provided in the channel pieces 329, 333 and welded or otherwise fixedly attached in place in an airtight manner. The frame 314 may also include a spine mount 342 or similar bracket used to operatively couple the frame to a spine hanger 252 or similar vertically extending structure during use. As should be appreciated given the benefit of this disclosure, when submerged in a paint bath 224 or the like, the bracket 328 will trap an air pocket within the airtight hollow interior 350, which in turn will isolate the rods 348 and any hangers attached thereto from the painting liquid. In contrast to the frame 214, in which multiple, horizontally spaced air pockets were formed, in this embodiment a single air pocket will surround all the hanger attachment points (e.g., rods 348). When used in a powder paint coating process or other spray application process, the bracket 328 will act as a faraday cage and repel the charged paint particles, again isolating the rods 348 or other hanger attachment points from the paint powder.

Figure 12B:
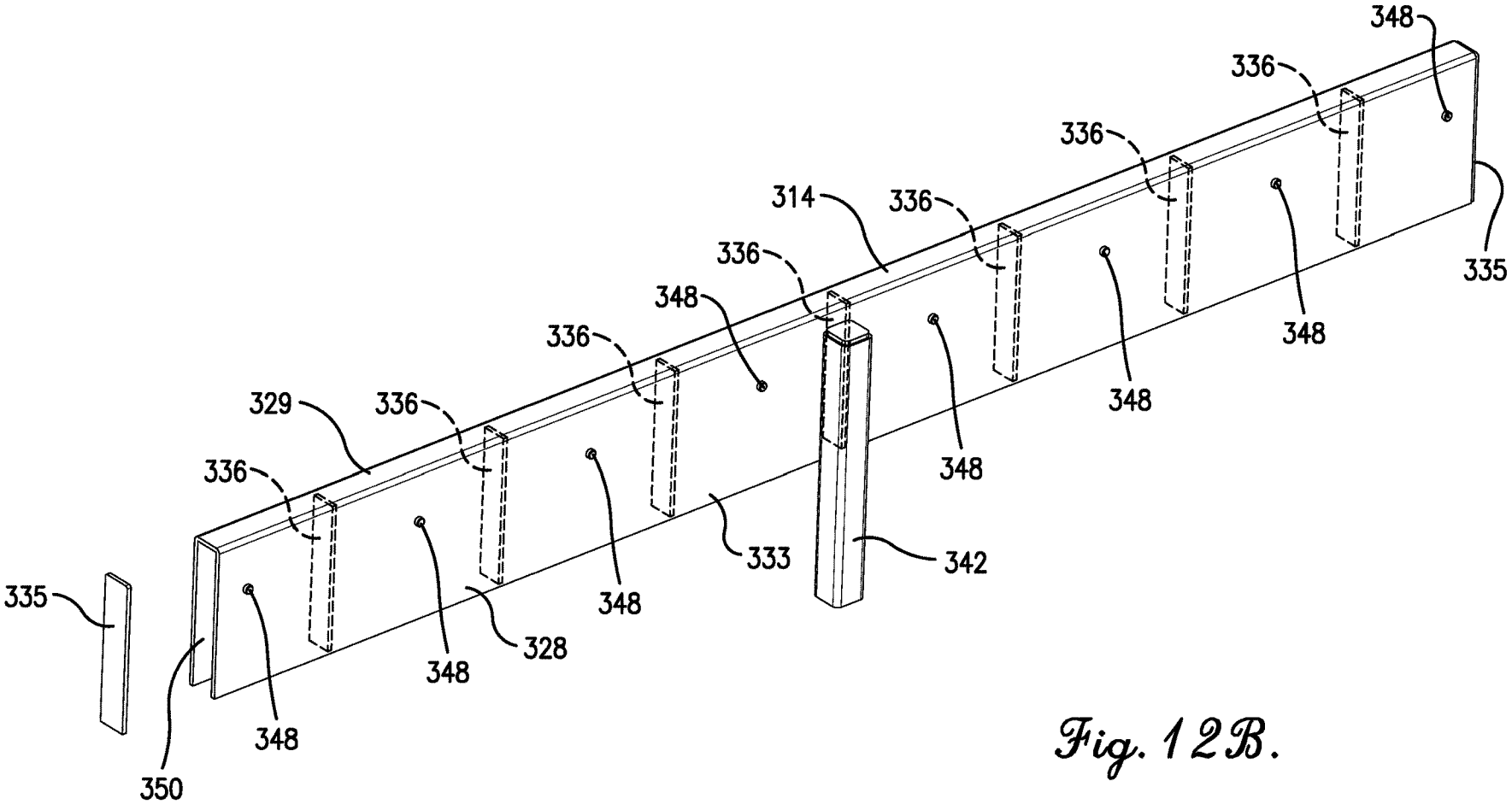

In some embodiments, as depicted in FIG. 12B, the bracket 328 may optionally include one or more internal dividers 336 that divide the hollow interior of the single bracket 328 into multiple, discrete pockets. For example, as shown in FIG. 12B the bracket 228 may optionally include multiple internal dividers 336 such that each rod 348 is within its own respective sub-pocket. In other embodiments, more or less internal dividers 336 may be employed such that, for example, more than one rod 348 are within a single sub-pocket. When the dividers 336 are coupled (e.g., welded) in an airtight manner, each sub-pocket exhibits similar benefits as the multiple, spaced apart brackets 228 when used in an e-coating process. More particularly, electrodeposition painting liquid enters each sub-pocket only minimally even if the coating frame 314 is tilted when submerged in the liquid, thus preventing the liquid from coating the hanger connection point (i.e., the rods 348). And, as should be appreciated given the benefit of this disclosure, for powder coating, spray painting, or other spray application processes, the internal dividers 336 optionally may be coupled in a non-airtight manner, because the faraday cage effect, which prevents a coating material from coating the hanger connection point, may be realized by the mere configuration of the bracket 328 and internal dividers 336, whether or not the sub-pockets are airtight.

In some embodiments, the single bracket (with or without one or more internal dividers such as the internal dividers 336 shown in FIG. 12B) may include a bottom plate that obstructs, but does not seal, the open lower end of the bracket to further restrict paint from entering the hollow interior during use. This will be more readily understood with reference to FIG. 13, which shows a coating frame 414 including a single bracket 428 housing a plurality of hanger attachment points such as rods 448 or similar in the hollow interior thereof, similar in construction and function to the bracket 328 discussed in connection with FIGS. 12A and 12B. Again, although not shown, the bracket 428 may optionally include one or more internal dividers such as internal dividers 336 shown in FIG. 12B that divide the hollow interior into two or more discrete sub-pockets. However, in this embodiment the bracket 428 further includes a plate 437 spanning the open, downward facing end of the bracket 428. The plate 437 includes a plurality of through holes 439, each aligned in the vertical direction with one of the rods 448. In the depicted embodiment the through holes 439 are oblong (i.e., they have a substantially stadium shaped perimeter), but any other suitably shaped through hole could be employed without departing from the scope of the invention. The through holes 439 provide passage for hangers (such as hangers 220) during use of the coating frame 414, while the remainder of the plate 437 helps to further restrict electrodeposition painting liquid or powder from entering an interior of the bracket 428 during use, thereby isolating the hanger attachment points (i.e., rods 448) from the charged paint.

What is claimed is:

1. A coating frame configured to be used in a process to coat a part with a coating material, said coating frame comprising:

a frame member;

at least one bracket coupled to the frame member and including a hollow interior defined by one or more side walls of the at least one bracket; and at least one hanger attachment point directly fixedly coupled, via welding or threaded connection, to the one or more side walls of the at least one bracket and extending into the hollow interior of the at least one bracket, wherein the at least one hanger attachment point comprises a rod that extends between the one or more side walls of the at least one bracket through the hollow interior, wherein the at least one bracket is configured to isolate the at least one hanger attachment point from the coating material.

2. The coating frame of claim 1, wherein the coating frame is configured to be used in a painting process, and wherein the at least one bracket is configured to isolate the at least one hanger attachment point from liquid paint by trapping an air pocket within the hollow interior.

3. The coating frame of claim 1, wherein the coating frame is configured to be used in a spray application process, the spray application process being one of a powder application process and a liquid paint application process, and wherein the at least one bracket is configured to isolate the at least one hanger attachment point from one of powder or liquid paint during spraying.

4. The coating frame of claim 1, wherein the frame member extends in a first direction, wherein the at least one bracket includes an airtight end and an opposing open end, and wherein the open end faces in a second direction substantially perpendicular to the first direction.

5. The coating frame of claim 1, wherein the at least one bracket includes a pair of opposing side walls, and wherein the rod extends from a first side wall to a second side wall.

6. The coating frame of claim 1 including a plurality of brackets, each of the plurality of brackets including at least one corresponding hanger attachment point coupled to the corresponding bracket and extending into the hollow interior of the corresponding bracket.

7. The coating frame of claim 1 further comprising an attachment bracket configured to attach the coating frame to an attachment point of a common frame member, wherein the attachment bracket is configured to isolate an interface of the attachment bracket with the attachment point from the coating material.

8. A coating system configured to be used in a process to coat a part with a coating material, said coating system comprising:

a common frame attachable to a conveyor line; and a plurality of coating frames operatively and conductively coupled to the common frame, each of the plurality of coating frames including:

a frame member;

at least one bracket coupled to the frame member and including a hollow interior defined by one or more side walls of the at least one bracket; and at least one hanger attachment point directly fixedly coupled, via welding or threaded connection, to the one or more side walls of the at least one bracket and extending into the hollow interior of the at least one bracket, wherein the at least one hanger attachment point comprises a rod that extends between the one or more side walls of the at least one bracket through the hollow interior, wherein the at least one bracket is configured to isolate the at least one hanger attachment point from the coating material.

9. The coating system of claim 8, wherein the frame member of each of the plurality of coating frames extends in a first direction, and wherein the plurality of coating frames are staggered along the common frame in a second direction substantially perpendicular to the first direction.

10. The coating system of claim 8, wherein the coating system is configured to be used in a painting process, and wherein the at least one bracket of each of the plurality of coating frames is configured to isolate the corresponding at least one hanger attachment point from liquid paint by trapping an air pocket within the hollow interior.

11. The coating system of claim 8, wherein the coating frame is configured to be used in a spray application process, the spray application process being one of a powder application process and a liquid paint application process, and wherein the at least one bracket of each of the plurality of coating frames is configured to isolate the corresponding at least one hanger attachment point from one of powder or liquid during spraying.

12. The coating system of claim 8, wherein the frame member of each of the plurality of coating frames extends in a first direction, wherein the at least one bracket of each of the plurality of coating frames includes an airtight end and an opposing open end, and wherein the open end faces in a second direction substantially perpendicular to the first direction.

13. The coating system of claim 8, wherein the at least one bracket of each of the plurality of coating frames includes a pair of opposing side walls, and wherein the rod of each of the plurality of coating frames extends from a first side wall to a second side wall of the corresponding bracket.

14. The coating system of claim 8 wherein each of the plurality of coating frames includes a plurality of brackets, each of the plurality of brackets of each of the plurality of coating frames including at least one corresponding hanger attachment point coupled to the corresponding bracket and extending into the hollow interior of the corresponding bracket.

15. The coating system of claim 8, wherein each of the plurality of coating frames includes an attachment bracket attaching the corresponding coating frame to a corresponding attachment point of the common frame member, wherein each of the plurality of attachment brackets is configured to isolate an interface of the corresponding attachment bracket with the corresponding attachment point from the coating material.

16. A method of coating a component comprising:

(a) suspending the component from a coating frame, wherein the coating frame includes a frame member, at least one bracket coupled to the frame member and including a hollow interior defined by one or more side walls of the at least one bracket, and at least one hanger attachment point directly fixedly coupled, via welding or threaded connection, to the one or more side walls of the at least one bracket, wherein the at least one hanger attachment point comprises a rod that extends between the one or more side walls of the at least one bracket through the hollow interior;

(b) conveying the coating frame and the component to a coating applicator;

(c) applying a coating material to at least a portion of the coating frame and at least a portion of the component via the coating applicator; and (d) during step (c), isolating the at least one hanger attachment point from the coating material via an air pocket formed within the at least one bracket.

17. The method of claim 16, wherein the coating applicator is a paint bath, wherein the coating material is liquid paint, and wherein step (c) includes submerging the at least the portion of the coating frame and the at least the portion of the component in the paint bath.

18. The method of claim 17 further comprising submerging the at least the portion of the component in the paint bath such that the at least the one hanger attachment point is below a surface of the paint bath and remains isolated from the liquid paint via the air pocket formed within the at least one bracket.

19. The method of claim 16, wherein the coating applicator is a spray nozzle, wherein the coating material is one of powder or liquid paint, and wherein step (c) includes spraying the at least the portion of the coating frame and the at least the portion of the component with the one of the powder and the liquid paint.

20. The method of claim 16 further comprising grounding one of the component and the coating material and positively or negatively charging the other one of the component and the coating material such that during step (c) the coating material is attracted to the component.

* * * * *